US005350247A

United States Patent [19]

Funamoto

[11] Patent Number: 5,350,247

[45] Date of Patent: Sep. 27, 1994

[54] PRINTER HAVING ERASING MECHANISM FOR REPEATED ERASURE

[75] Inventor: Masaya Funamoto, Kasugai, Japan

[73] Assignee: Brother Kogyo Kabushiki Kaisha, Aichi, Japan

[21] Appl. No.: 83,633

[22] Filed: Jun. 28, 1993

[30] Foreign Application Priority Data

Jul. 10, 1992 [JP] Japan ..... 4-183811

[51] Int. Cl.[5] ..... B41J 29/373

[52] U.S. Cl. ..... 400/696; 400/144.2; 400/697.1

[58] Field of Search ..... 400/144.2, 157.3, 695, 400/696, 697, 697.1

[56] References Cited

U.S. PATENT DOCUMENTS

| | | | |
|---|---|---|---|
| 4,307,971 | 12/1981 | Kane, III et al. | 400/697 |
| 4,572,687 | 2/1986 | Croley et al. | 400/696 |
| 4,692,045 | 9/1987 | Makita | 400/697 |
| 5,171,094 | 12/1992 | Kawamura | 400/697 |
| 5,244,289 | 9/1993 | Sasaki | 400/144.2 |

FOREIGN PATENT DOCUMENTS

| | | | |
|---|---|---|---|
| 0142883 | 8/1983 | Japan | 400/697.1 |
| 58-142883 | 8/1983 | Japan . | |
| 0036183 | 2/1985 | Japan | 400/697 |

*Primary Examiner*—Edgar S. Burr
*Assistant Examiner*—Christopher A. Bennett
*Attorney, Agent, or Firm*—Kane, Dalsimer, Sullivan, Kurucz, Levy, Eisele and Richard

[57] ABSTRACT

A printer capable of completely erasing printed characters while reducing noise which may be generated during the erasure. After an erase key is manipulated and the holder member is moved to its erase position, a motor is energized and driven at a motor current level of I1 and I2 from a time t0 when the erasing operation starts. A print hammer strikes onto a printing paper through a type and a correction ribbon at a hammer speed of V1. Thereafter, motor current level of I3 is applied to the motor, so that the print hammer presses the printing paper at a contacting pressure of P1. In the subsequent erasure operation, the motor current level of I11 and I12, which are smaller than I1 and I2 in the first erasure are applied to the motor. Thus, the hammer speed when striking onto the printing paper by the hammer is lower than V1. Accordingly, contacting pressure of the print hammer onto the printing paper becomes P11, which is smaller than P1 of the first erasure.

13 Claims, 16 Drawing Sheets

PRINTER HAVING ERASING MECHANISM FOR REPEATED ERASURE

BACKGROUND OF THE INVENTION

The present invention relates to a daisy-wheel type printer, and more particularly to a type thereof in which erasure operation is made by pressing a correction ribbon several times with a print hammer.

In a conventional printer of this type, a print image can be formed by striking a type of tile daisy wheel from behind by a print hammer driven by a solenoid. For erasing the print image thus formed, Japanese Patent Application Kokai No. 58-142883 discloses an erasing method in which the print hammer repeatedly strikes the printed character through the type and a correction ribbon. The first strike of the hammer is weak enough so that ink does not permeate into the printing paper. Then the next strike is stronger than the first. With this erasing method, printed character can be almost perfectly erased.

In a commonly assigned U. S. patent application Ser. No. 07/813,493 filed on Dec. 26, 1991, disclosed is a printer having a print hammer driven in association with a cam body rotated by a motor. The printing hammer presses the rear side of the type, so that the type is depressed onto the printing paper through the printing ribbon to thus perform printing.

Accordingly, the latter printer where the type is pressed can reduce noise generated during printing in comparison with the former printer where the rear side of the type is struck by the print hammer.

However, in the latter pressor type printer, the type and the printing paper are in contact from several mS to several ten mS. This is longer than the several hundred μS to several mS range of the former impact type printer.

If the method wherein characters are erased by striking them several times is applied to the pressor type printer in which prolonged contacting period results between the type and the printing sheet, ink transferred to the correction ribbon at the initial pressing operation for erasing is retransferred onto the printing sheet in the second and subsequent erasure operation or alternatively, adhesive material on the correction ribbon may be transferred to the printing sheet. As a result, complete character erasing may not be achievable, and printing quality may be extremely degraded if the printing is achieved on a character-erased portion provided by the adhesive material.

SUMMARY OF THE INVENTION

Therefore, it is an object of the present invention to solve the above problems in a printer in which printing operations are performed by non-impactedly pressing a type onto a print paper and platen through a print ribbon by a hammer which is operataively driven by the rotation of a cam rotationally driven by a motor, and to provide a printer capable of completely erasing printed characters while reducing noise attendant to the erasing operation.

This and other objects of the present invention will be attained by providing a printer for generating a printed character on a printing paper using a print ribbon and for erasing the printed character using a correction ribbon, the printer including a platen, a carriage, and a motor control means. The carriage is driven to reciprocally follow the platen . The carriage mounts thereon a daisy wheel having a plurality of types, the print ribbon, the correction ribbon, a print hammer, a cam unit, and a drive motor for rotatably driving the cam unit . Printing operation is made by non-impactedly pressing the type against the printing paper and the platen through the print ribbon by means of the print hammer operatively driven by the rotation of the cam unit . The erasure operation is performed by pressing a plurality of times the type onto the printing paper and the platen through the correction ribbon by means of the print hammer. The motor control means controls the rotation of the motor during erasure operation for providing a pressing force applied by the print hammer during a second and subsequent pressings smaller than the pressing force applied during a first pressing.

In a printer according to the present invention with the above mentioned construction, when erasing a printed character by several pressing operations, the motor control means controls the rotation of the motor, and weakens the pressing force of the second and subsequent erasure operation by the hammer compared to the first erasure operation. In other words, when erasing a character by several pressing operations, the pressing force of the hammer during the second and subsequent erasure operation is weaker than during the first erasure operation. Therefore, the printed character can be completely erased and the noise generated then can be reduced.

DETAILED DESCRIPTION OF THE PREFERRED EMBODIMENTS

A printer according to one embodiment of the present invention will hereinafter be described with reference to FIGS. 1 through 16. The present invention is applied to an electronic typewriter where a single DC motor performs a printing process, a taking-up process for winding a print ribbon in connection with the printing process, an erasing process, and a taking-up process for winding an correction ribbon in connection with the erasing process.

Figure 1:
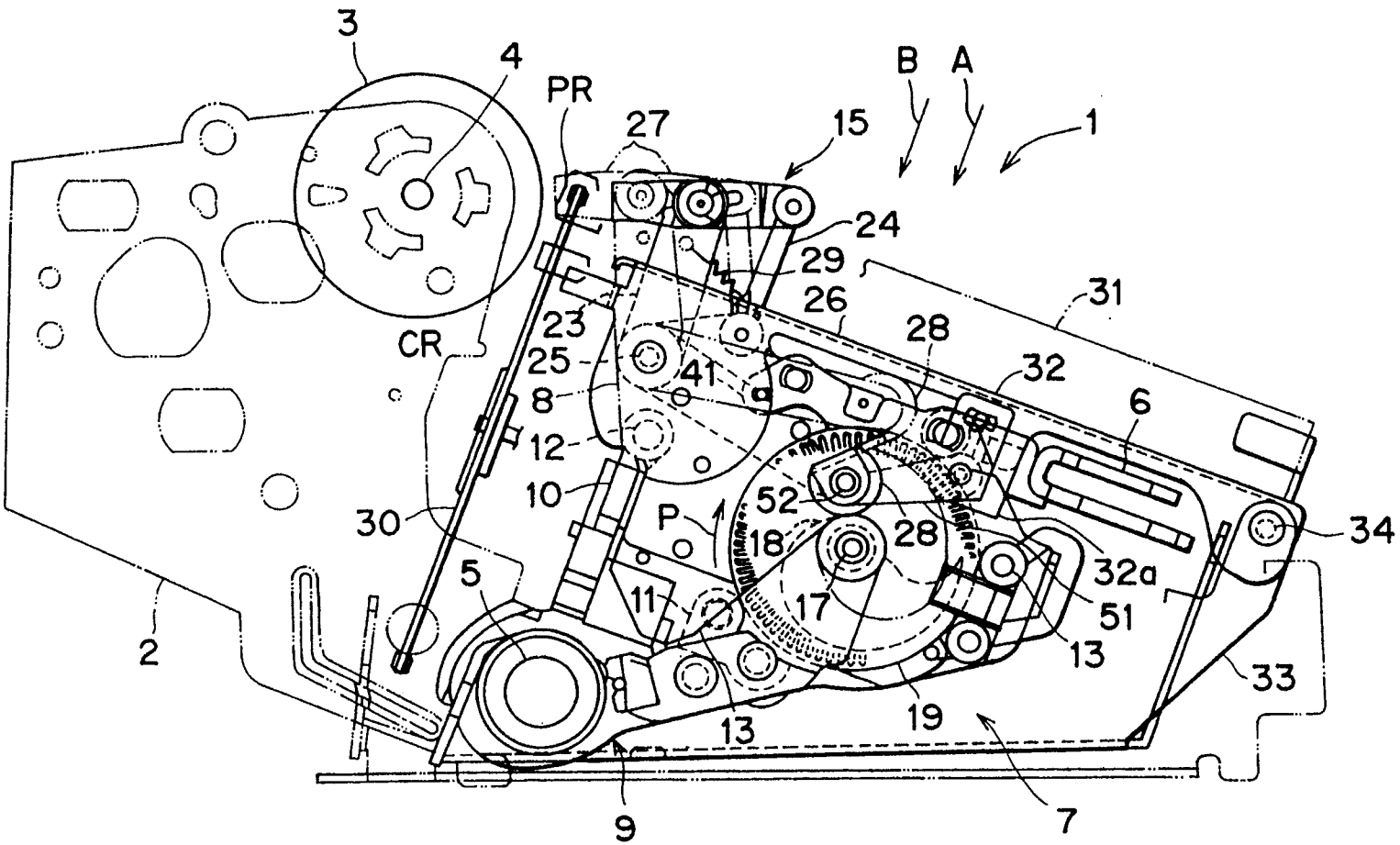
FIG. 1 is a side elevational view showing an internal mechanism of an electronic typewriter.
Figure 2:
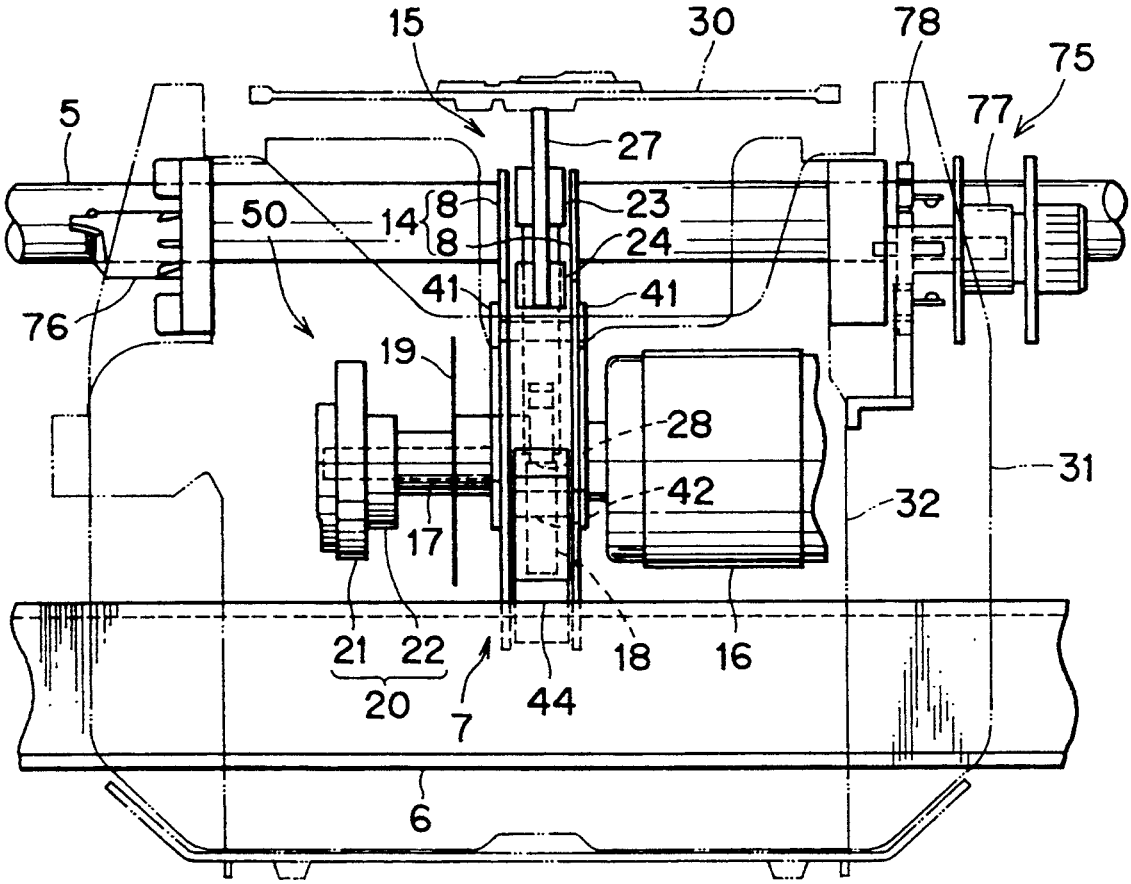
FIG. 2 is a view as viewed in the direction indicated by the arrow A in FIG. 1.

As shown in FIGS. 1 and 2, a typewriter 1 has a casing including side wall panels (machine frames) 2 positioned at respective lefthand and righthand ends thereof. A platen 3 is disposed between the side wall panels 2 and rotatably supported thereby in the vicinity of opposite ends of a platen shaft 4. The platen 3 can be rotated about its own axis by a driven gear (not shown) fixed to the lefthand end of the platen shaft 4 by a platen drive mechanism (not shown) having a line feed motor (see FIG. 10) 39.

Between the side wall panels 2, a guide shaft 5 and a guide member 6 having a substantially U-shape as viewed in side elevation are arranged parallel to the platen 3. A carriage 7 movably supported in the lateral direction by the guide shaft 5 and the guide member 6 will be described below with reference to FIGS. 1 through 5.

A pair of main frames 8, which are spaced laterally to the left and right of each other at a predetermined distance and which have the form of a substantially rectangular plate, are positioned laterally between, and extend in a direction normal to, the guide shaft 5 and the guide member 6. A support member 9 is laterally movably and rotatably supported on the guide shaft 5. The support member has a first and second support arms 10 and 11. The main frames 8, 8 are supported at the upper ends of the first and second support arms 10 and 11 and fixed from the outer surface there by pins 12 and 13. The first and second support arms 10 and 11 serve as spacers positioned between the main frames 8 and 8. The main frames 8 comprise a carriage body 14.

A print mechanism 15 will now be described below. A DC motor 16 is fixedly supported on the righthand main frame 8 to prevent its own rotation. The DC motor 16 has a drive shaft 17 extending leftward through the main frames 8. To the drive shaft 17 are secured, successively from the motor 16, a print cam 18 positioned between the main frames 8 and having a whirl shape in side view, an encoder disk 19 for detecting rotation speed of the motor 16, a ribbon supply cam 22 for supplying the print ribbon PR stepwise, and a lifter cam 21 for lifting a holder member 32 into an erasing position.

The print cam 18, the ribbon supply cam 22, and the lifter cam 21 comprise a cam body 20, wherein the ribbon supply cain 22 and the lifter cam 21 are integrally formed as the cam body 20. In FIG. 1, a printing start position for the print cam 18 is shown by a dotted line, and an origin setting position for the print cam 18 is shown by two-doted chain line.

Figure 4:
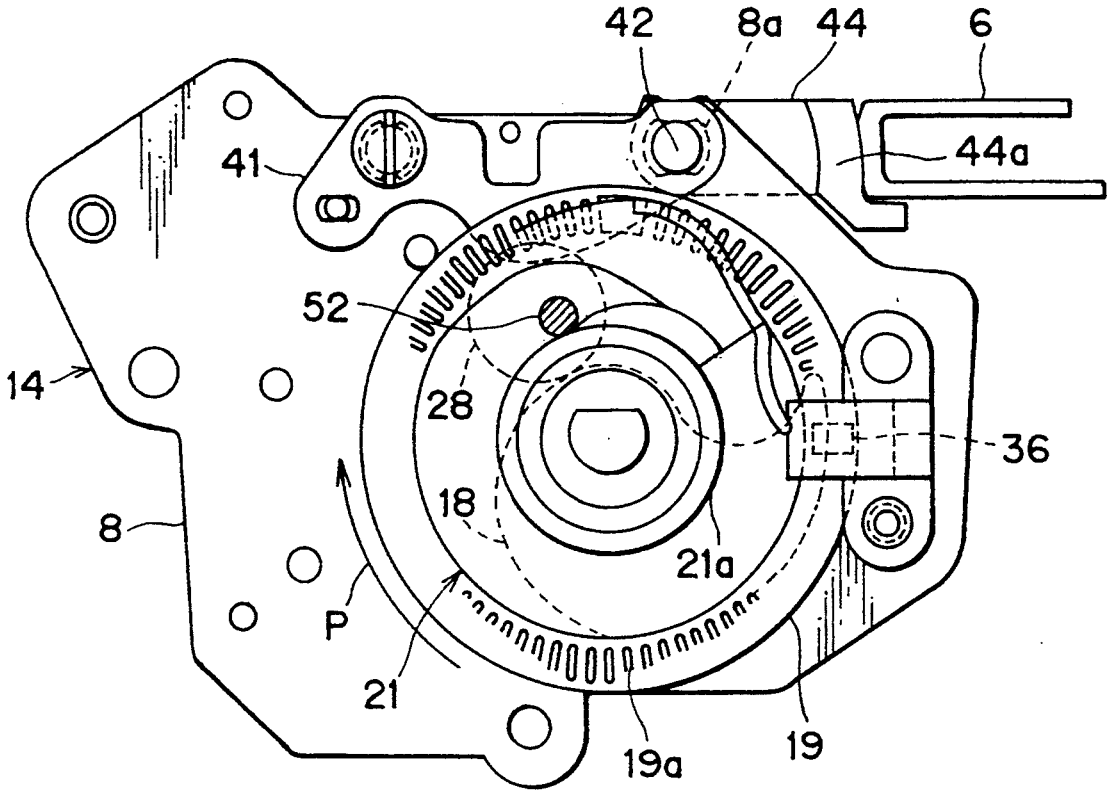
FIG. 4 is a side elevational view showing a main frame.
Figure 5:
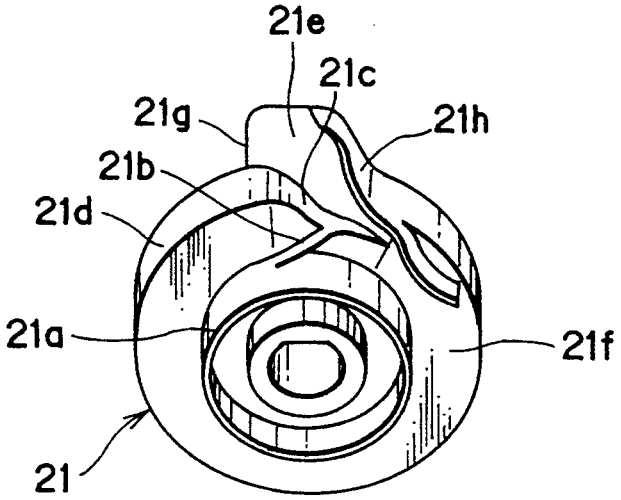
FIG. 5 is a perspective view showing a lifter cam.

As illustrated in FIG. 4, a plurality of slits **19*a* are formed in a circular array in the outer periphery of the encoder disc 18 so that inter-slit width equals slit width. A photo-interrupter 36 is fixed to a lefthand main frame 8 for detecting each slit 19*a*. That is, the photo-interrupter 36 outputs a slit signal to an input/output interface 85 of a control device C each time the interrupter 36 detects each edge of the slits 19*a* which move by the rotation of the encoder disc 19**.

A turn lever 23 which has a substantially V shape as viewed in side elevation and a link 24 are provided to the main frames 8. A central portion of the turn lever 23 and a lower end portion of the link 24 are angularly movably supported on upper rear end portions of the main frames 8 by pins 25, 26, respectively. A print hammer 27 disposed in the lengthwise direction to confront the platen 3 is rotatably pivoted at the lower end thereof on the upper end of the link 24 and at a central portion thereof on the upper end of the turn lever 23.

Furthermore, a cam follower 28 is rotatably mounted on the front end of the turn lever 23. A tension spring 29 is stretched between an upper end portion of the turn lever 23 and a lower end portion of the link 24 in such a manner that the cam follower 28 is kept in abutment with the surface of the print cam 18.

A daisy wheel 30 is rotatably driven by a wheel drive motor 37 (see FIG. 10) and a wheel drive mechanism (not shown). A ribbon cassette 31 which stores therein a printing ribbon PR is placed on a holder member 32 vertically swingably supported by a support shaft 34 on the auxiliary frame 33.

The carriage 7 is laterally reciprocated along the platen 3 through a drive wire (not shown) by a carriage drive motor 38 (see FIG. 10) and a drive mechanism (not shown).

As shown in FIG. 4, the outer curved cam profile of the print cam 18 has three general sections slidingly contacted by the cam follower 28. That is, a generally front half section of the cam profile with a large radius enlarging ratio, a generally rear half section with a minute radius enlarging ratio including a strike portion where the cam follower 28 slides when the print hammer 27 strikes the platen 3, and a hooking curved section extending arcuately by a predetermined length over the slidable range so as to prevent the cam follower 28 from being separated away from the surface of the cam 18 after the stroke of the print hammer 27.

Accordingly, in FIG. 1, the cam follower 28 is lifted along the cam surface of the print cam 18 when the motor 16 is rotated in a printing direction P at high velocity by a predetermined angle from a print start position. Therefore, the turn lever 23 is turned in a counterclockwise direction and the print hammer 27 strikes the platen via a type character **30*a* of the daisy wheel 30** and the print ribbon PR.

Here, a pair of adjusting plates 41 extending in frontward/rearward direction of the printer are disposed to the outer sides at the upper portions of the main frames 8. At the fore ends of the adjustment plates 41 is fixed a support shaft 42 inserted into slots **8*a* formed in the main frames 8. An abutment member 44 is angularly movably supported at its rear end on the support shaft 42, and has an engaging member 44*a* at its front end held in slidable engagement with a rear end of the guide member 6**.

An erase mechanism 50 lifts the holder member 32 from a printing position to an erasing position to bring an correction ribbon CR, instead of the print ribbon PR, in confronting relation to the print hammer 27 for erasing a printed character. The erase mechanism 50 will now be described below with reference to FIGS. 1 through 5.

The lifter cam 21 and the ribbon supply cam 22 are formed integrally as a cam body 20. The lifter cam 21 provided at the left side thereof includes a reference cam 21*a* having uniform radius from a center of the cam 21, a first inclined cam surface 21*b* extending contiguously from the reference cam 21*a* and having an increasing radius, a second inclined cam surface 21*c* extending contiguously from a half way portion of the first inclined cam surface 21*b* and reaching an outer peripheral cam 21*d*, a thin guide wall 21*e* extending in the radius enlarging direction from the right side of the second inclined cam surface 21*c*, and a guide rib 21*h* extending from an outer contour of the guide wall 21*e*. Thickness of the guide wall 21*e* is gradually reduced toward a left edge portion 21*g* from a left end surface 21*f*. The guide rib 21*h* protrudes in the radius reducing direction from the guide wall 21*e* to the left end surface 21*f*.

A follower pin 52 is in engagement with the lifter cam 21. The follower pin 52 is movable rightwardly and leftwardly and is supported at a lower end portion of a support member 51 whose upper end portion is fixed to a side wall 32*a* provided at the left end portion of the holder member 32. The follower pin 52 is normally biased rightwardly by a coil spring 53. At a print start phase, as shown in FIG. 4, a tip end portion of the follower pin 52 is positioned on the reference cam 21*a* from above because of own weight of the holder member 32, so that the holder member 32 has a printing position (reference swing position) as shown in FIG. 1. At the same time, a tip end face of the follower pin 52 abuts the left side surface 21*f* from the left. That is, vertical swinging range of the holder member 32 is determined by the vertically moving range of the follower pin 52. The positional relationship among the print cam 18, the lifter cam 21 and the follower pin 52 at a print start phase is shown in FIG. 4.

Accordingly, when the cain body 20 is rotated by the motor 16 by a predetermined angle in a direction opposite the printing direction P (non-printing direction) from a print start phase angle position shown in FIG. 4, the follower pin 52 is moved upwardly by the first inclined cam surface 21b, so that the holder member 32 is also upwardly pivoted corresponding to the distance of the upward movement of the follower pin 52. Then, when the cam body 20 is rotated in the printing direction P, the follower pin 52 reaches the outer peripheral cam surface 21d by way of the second inclined cam surface 21*c*. Therefore, the holder member 32 is further pivoted upwardly to obtain the erase position. At this moment, the correction ribbon CR confronts the printing hammer 27.

Figure 3:
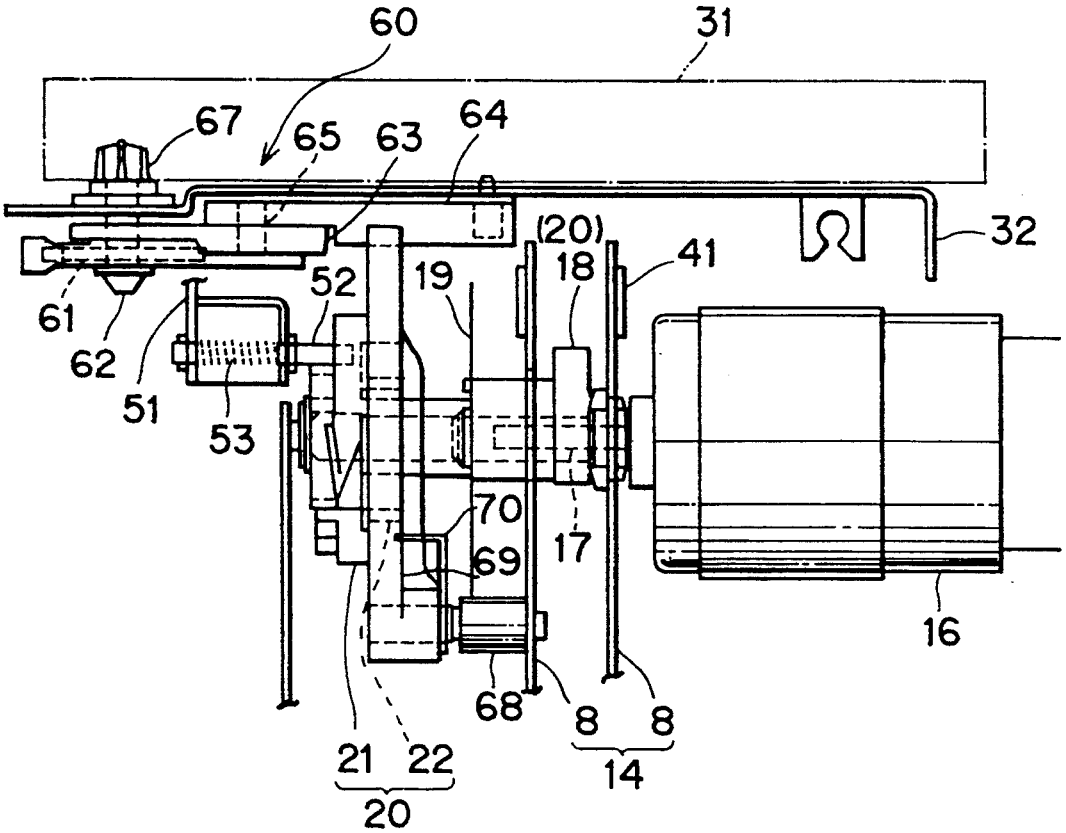
FIG. 3 is a fragmentary front elevational view showing the internal mechanism of the electronic typewriter.
Figure 6:
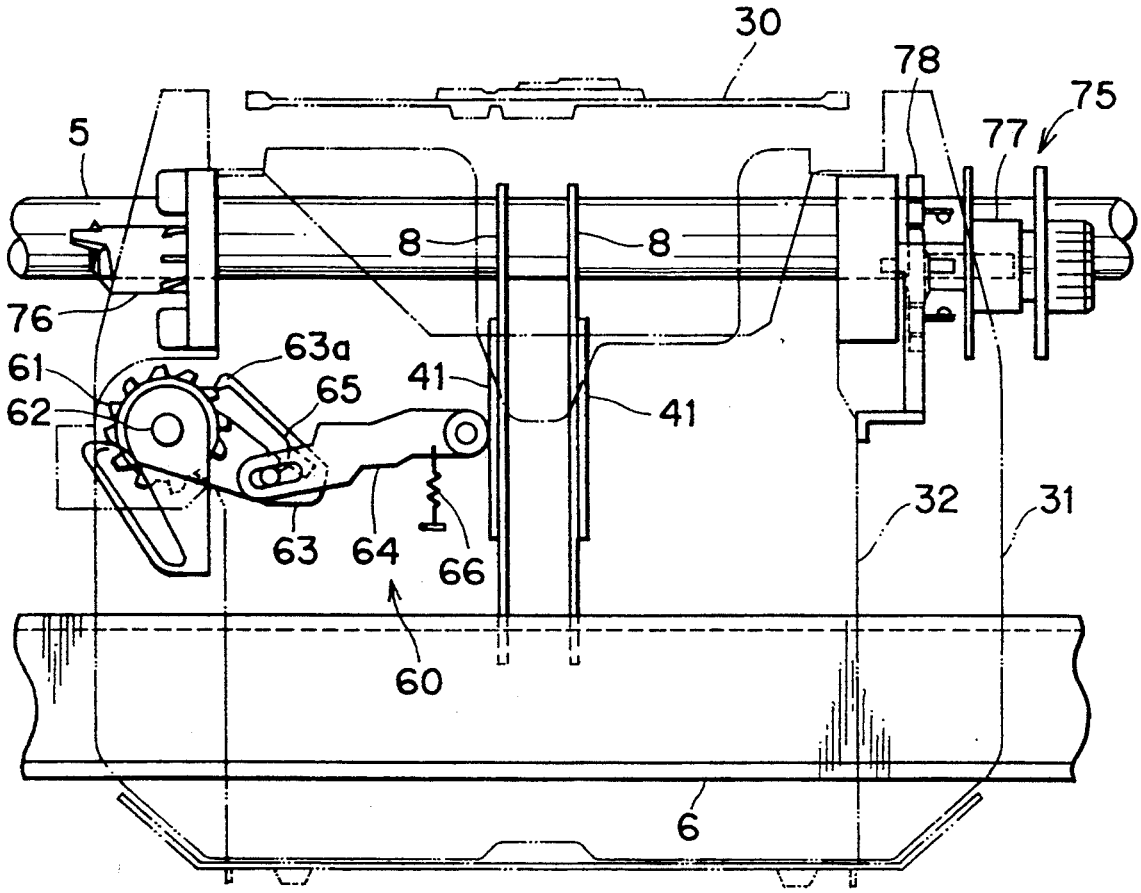
FIG. 6 is a view as viewed in the direction indicated by the arrow B in FIG. 1.

A print ribbon take-up mechanism 60 for winding a length of the print ribbon PR on a take-up spool in each printing process will be described below with reference to FIGS. 3, 6, and 7.

A ratchet 61 having a plurality of teeth is rotatably supported on a lower lefthand end portion of the holder member 32 by a pin 62 . Further, first through third swing members 69, 64 and 63 are provided . The third swing member 63 is rotatably supported on the pin 62 and has a feed pawl 63*a*. The third swing member 63 is connected by a coupling pin 65 to the second swing member 64 that is angularly movably mounted on the holder member 32. The second swing member 64 is normally urged to turn in counterclockwise direction in FIG. 6 under the resiliency of a tension spring 66. A take-up spool 67 is fixed to the pin 62.

On the other hand, the first swing member 69 is rotatably supported at a lower end thereof on a pivot pin 68 fixed to the lefthand main frame 8 in positional alignment with the ribbon supply cain 22 having a whirl shape. The upper end of the first swing member 69 abuts against the second swing member 64 in the vicinity of the base end of the second swing member 64. The first swing member 69 has a substantially circular hole 69*a* defined therein with the ribbon supply cam 22 positioned in the circular hole 69*a*. A projection 69*b* extends inwardly from the circular hole 69*a*, so that the projection 69*b* can abut the profile of the ribbon supply cam 22. The first swing member 69 is normally urged to turn clockwise in FIG. 7 under the resiliency of a torsion spring 70 coiled around the pivot pin 68. Therefore, the projection 69*b* of the first swing member 69 abuts against a portion of the ribbon supply cam 22 at all times.

Figure 7:
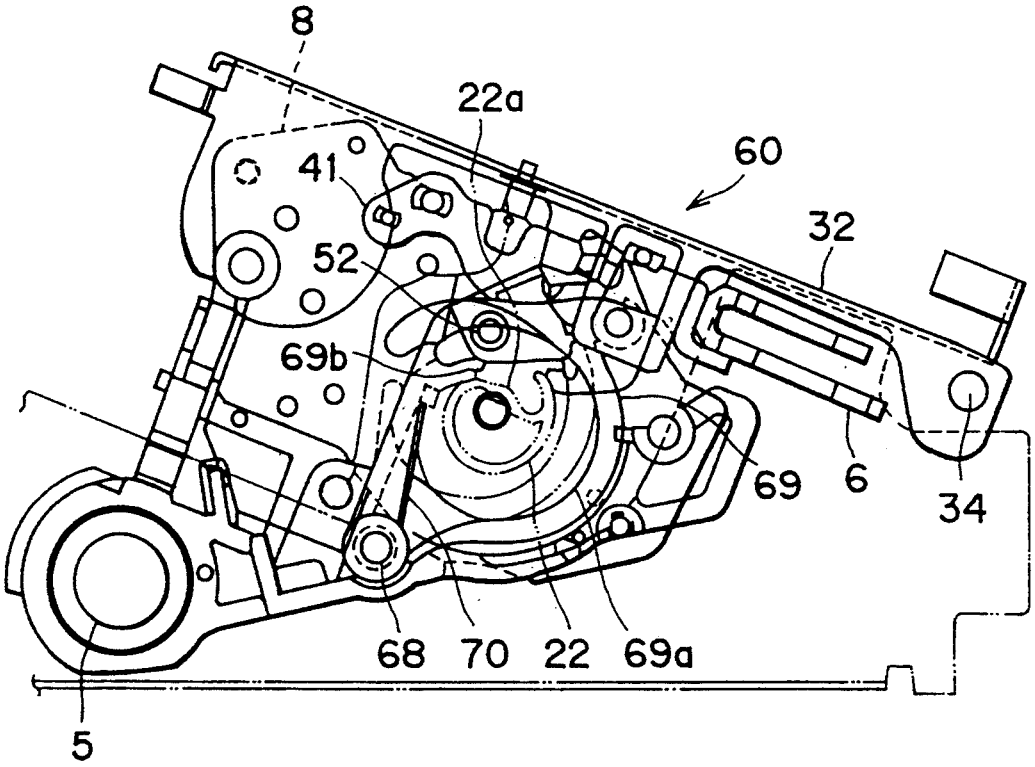
FIG. 7 is a side elevational view showing an essential part of the internal mechanism.

As a result, when the ribbon supply cam 22 is rotated in a printing direction P by the motor 16, the first swing member 69 is turned in the counterclockwise direction in FIG. 7 in accordance with the cam profile of the ribbon supply cam 22 through the projection 69*b*. Therefore, the second swing member 64 is turned in the clockwise direction in FIG. 6. Thus, the third swing member 63 is turned in the counterclockwise direction, causing the feed pawl 63*a* to turn the ratchet 61 by an angular interval corresponding to one tooth of the ratchet 61. Immediately prior to the printing operation, the print ribbon PR is fed stepwise in a predetermined increment by the rotation of the take-up spool 67.

Next, a correction ribbon take-up mechanism 75 for winding a length of the correction ribbon CR on a take-up spool 77 in an erasing process will be described below with reference to FIGS. 2 and 6. At the rear end of the holder member is rotatably mounted a correction ribbon supply spool 76 on the side wall 32*a* and a correction ribbon take-up spool 77 on tile righthand side wall. The take-up spool 77 is connected to a ratchet 78 having a plurality of teeth. A feed pawl 79 (see FIG. 8) for turning the ratchet 78 in one tooth increments is erected on the auxiliary frame 33 behind the ratchet 78.

Figure 8:
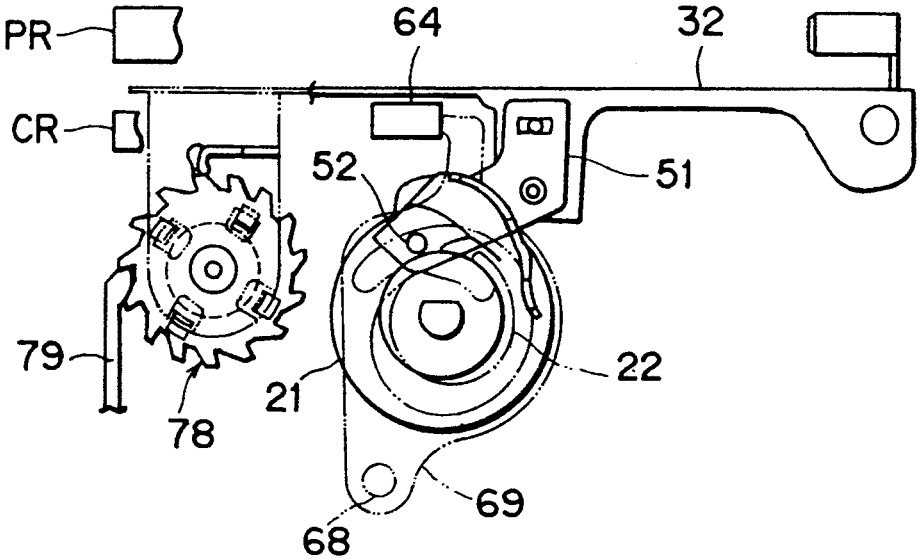
FIG. 8 is a side elevational view showing an essential part of the internal mechanism in a start print position.

As described above in connection with the erase mechanism 50, provided that cam body 20 has the phase angle of 0° at the print starting phase, when the cam body 20 is rotated in the non-printing direction by about 55° from the 0° phase angle in FIG. 8 (hereinafter simply referred to as the phase angle of −55° ), the follower pin 52 is moved upwardly along the first inclined cam surface 21*b*, and then positioned on the second inclined cam surface 21*c*.

Figure 9:
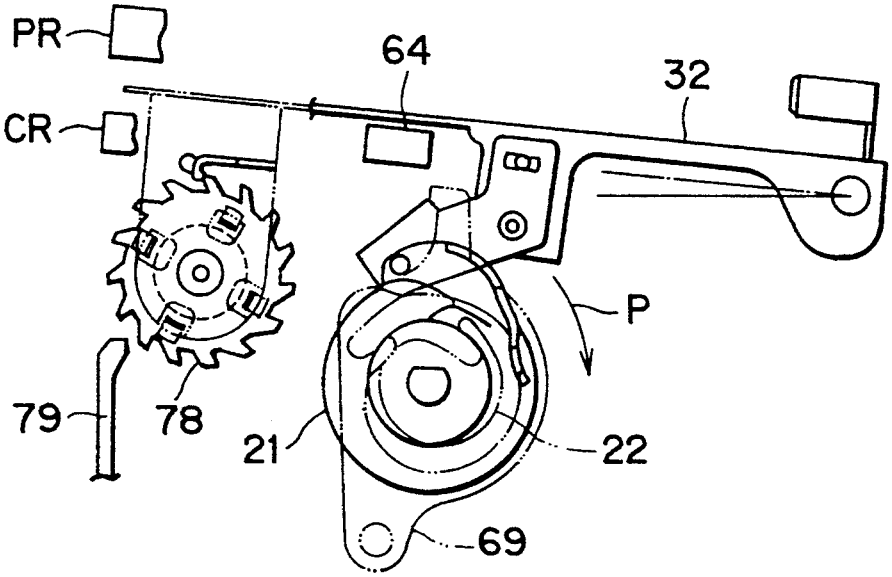
FIG. 9 is a view corresponding to FIG. 8 showing the holder switched to a erasure position.

Further, when the cam body 20 is rotated in the printing direction from about −55° to 0° , the follower pin 52 is moved onto the second cam surface 21*c* to reach the outer peripheral cam surface 21*d* (see FIG. 9). That is, at this time, the position of the holder member 32 is switched to the erase position where the correction ribbon CR confronts the printing hammer 27. When the cam body 20 is rotated in the non-printing direction to −90° after the cam body 20 is rotated in the printing direction P from 0° to perform the erase operation, the follower pin 52 is reversedly moved from the outer peripheral cam surface 21*d* to the reference cam 21*a* by way of the second inclined cam surface 21*c*, so that the holder member 32 is moved downwardly to restore the original print position. During the descent of the holder member 32, the feed pawl 79 rotates the ratchet 78 by one tooth, so that the correction ribbon CR is fed by a step. In FIGS. 8 and 9, the lifter cam 21 is shown by a solid line and the ribbon supply cam 22 is shown by a dotted chain line, and the first swing member 69 is shown by a two dotted chain line.

Figure 10:
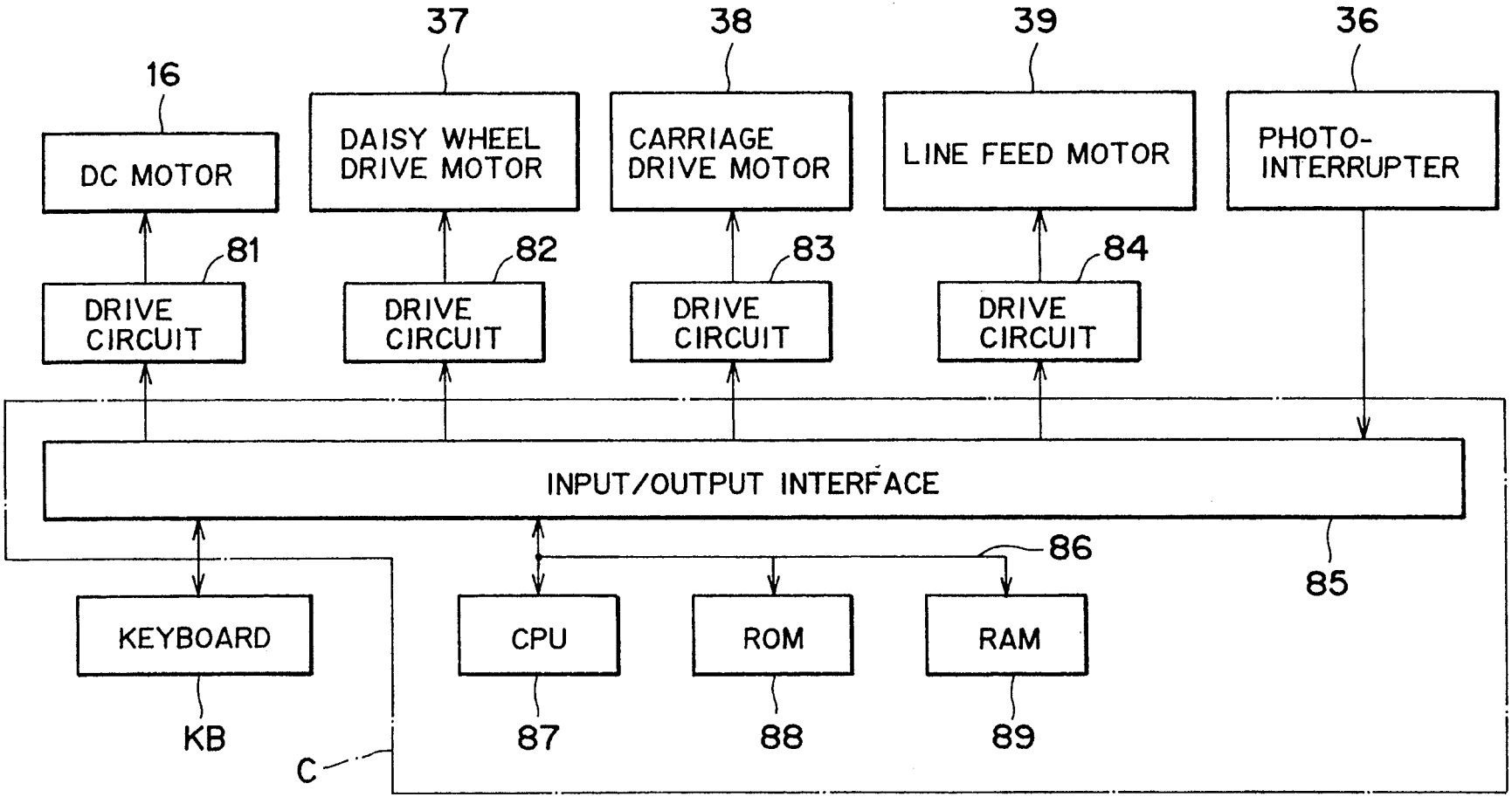
FIG. 10 is a block diagram showing a control system of the print device.

Next, a control arrangement of the electronic typewriter is shown in a block diagram of FIG. 10.

The motor 16 has a structure capable of altering rotation speed by PWM (pulse width modulation) control. That is, a control device C determines a duty of time, i.e., a duty ratio, for supplying driving current to the motor 16 within a predetermined period so as to obtain a preset rotation speed by using the slit signal inputted from the photo interrupter 36. Pulse signals indicative of the duty ratio is supplied to a driving circuit 81 for outputting the driving current corresponding to the pulse signals to the motor 16.

The control device C which constitutes motor control means of the present invention includes a CPU 87, an input/output interface 85, a ROM 88 and a RAM 89 those being connected to the CPU 87 by a bus 86 such as a data bus. The ROM 88 stores therein a drive control program for driving the motor 16 to perform a print or erasure operation, and another drive control program for driving the motors 37 through 39 in association with the print or erasure operation. The RAM 89 contains therein a buffer for temporarily storing data required for controlling the typewriter 1 and a computed result of the CPU 87, a counter for counting the slit signals output in sequence from the original set position, a pointer and various memories.

The character print and erasure operation will be explained hereinafter with reference to FIGS. 11 through 16.

Figure 11:
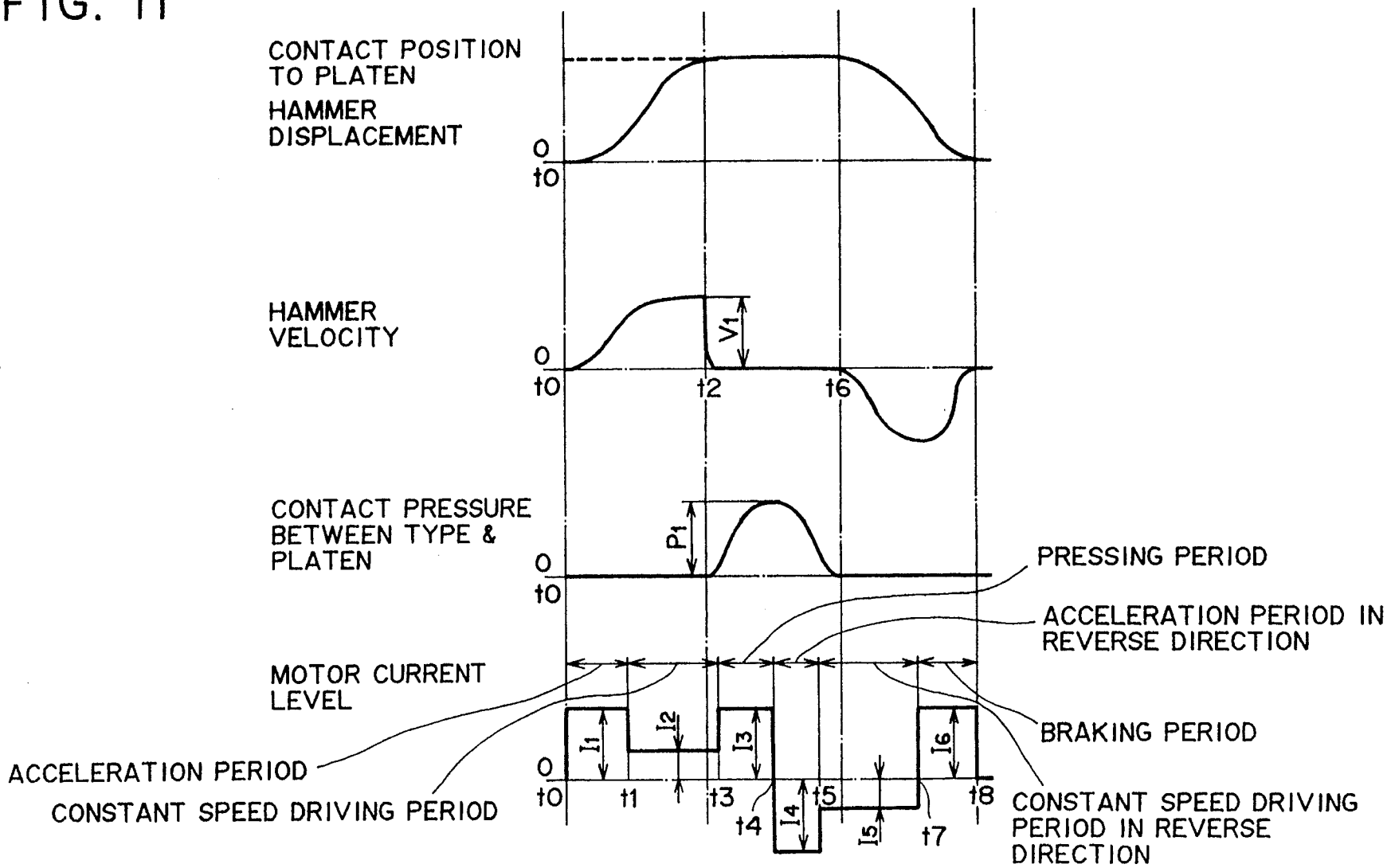
FIG. 11 is a chart showing motor drive current and print hammer movement at time of printing.

As shown in FIG. 11, in the time period from time t0 when printing starts by the manipulation of a character key on the keyboard KB, until time t1 when the slit signal reaches a rotation speed at which slit signals are detected every 0.3 milliseconds, the control device C continuously drives the motor 16 in the normal rotation direction while controlling the duty ratio. In between time t0 and time t1, motor 16 is driven at a motor electric current level of about I1.

Afterwards, the motor is energized at a motor electric current level of about I2 and the slit signal is maintained at a rotation speed at which slit signals are detected every 0.3 milliseconds. The print cam 18 is rotated through the rotation of the motor 16. The cam follower 28 arcuately slides along the curve section of the print cam, the section having high radius enlarging ratio. Because of this, the velocity of the movement of the print hammer 27 (hereinafter referred to as "a velocity of the print hammer") achieves a predetermined velocity V1. Afterward, the cam follower 28 slides along the other curve section of the print cam, the other section having a minute radius enlarging ratio, so that the velocity of the print hammer 27 maintains the predetermined velocity V1 until time t2 (to be described later).

The print hammer 27 contacts the platen 3 through the type 30*a* of the daisy wheel 30 and the print ribbon PR at time t2. The control device C recognizes time t2 from the fact that the slit signal is not detected at time intervals even exceeding 0.3 milliseconds. Afterward, between time t3 and time t4, control device C drives the motor 16 in the normal direction through a motor electric current level of I3.

As a result, the print hammer 27 presses the print paper 90 on the platen 3 through the type 30*a* of the daisy wheel 30 and the print ribbon PR at a contacting pressure of P1. At this moment, the hammer velocity V1 of the print hammer 27 is slower than the velocity of print hammers driven by conventional solenoids and the like. As a result, the strike noise generated at the time of printing is reduced.

Figure 12:
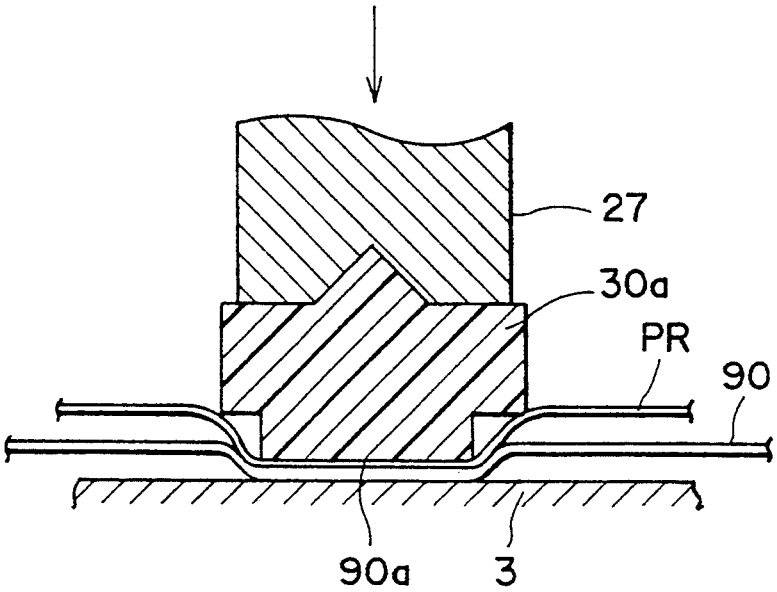
FIG. 12 is a cross-sectional magnified view of an essential component showing a printing situation.
Figure 13:
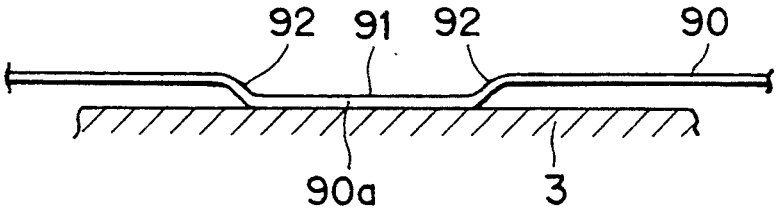
FIG. 13 is a cross-sectional magnified view of an essential portion showing effects of printing on printing paper.

That is, rotation of the motor 16 starts from print start time t0, and the print hammer 27, as shown in FIG. 12, strikes the print paper 90 on the platen 3 through the type 30*a* and the print ribbon PR at a hammer velocity V1 at time t2. A motor electric current level of I3 energizes the motor 16 between times t3 and t4, and therefore, the print hammer presses the platen 3 from time t2 to time t4, forming, as shown in FIG. 13, an indentation 90*a* in the print paper 90. The ink 91 in the print ribbon PR adheres to the indentation 90*a* and ink 92 adheres to a portion (an inclined portion) around the indentation 90*a* in a state scrubbed by the type 30*a*.

In this way, although the print hammer 27 of a typewriter according to the depicted embodiment has a hammer velocity V1 much slower than that of conventional typewriters, the resultant small striking energy is compensated by the pressing operation. In a general typewriter, the print operation can be performed with impact obtained by kinetic energy of the print hammer 27 only, whereas in the electronic typewriter in this embodiment, the print operation can be performed with energy generated by the impact and the pressure energy of the print hammer 27.

Subsequently, upon operation of an erasure key as described previously the motor 16 rotates counterclockwise and in the print direction and the holder member 32 is shifted to the erasure position (see FIG. 9). From time t0 which starts character erasing as indicated by the solid line in FIG. 14, the motor 16 is driven by electric energy levels I1 and I2 in the same way as during printing. The print hammer 27 strikes, through the type 30*a* of the daisy wheel 30 and the correction ribbon CR onto the print paper 90 on the platen 3 at hammer velocity V1. Afterward, the motor 16 is energized at electric current level I3 and the print hammer 27 presses the print paper 90, through the type 30*a* and the correction ribbon CR, at a contact pressure of P1. From this, the correction ribbon CR peels the ink 92 and the ink 91 adhering to the indentation 90*a* shown in FIG. 13 from the print paper 90.

Figure 16:
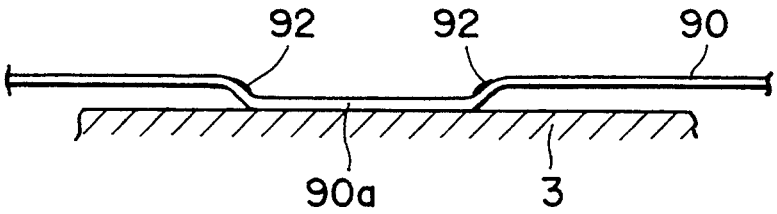
FIG. 16 is a view corresponding to FIG. 13 showing printing paper in an erasing situation.

However, as shown in FIG. 16, not all of the ink 92 adhering to the perimeter of the indention 90*a* will be peeled off, so the print paper 90 must be struck and pressed several consecutive times by the print hammer 27 through the type 30*a* and the correction ribbon CR.

Figure 14:
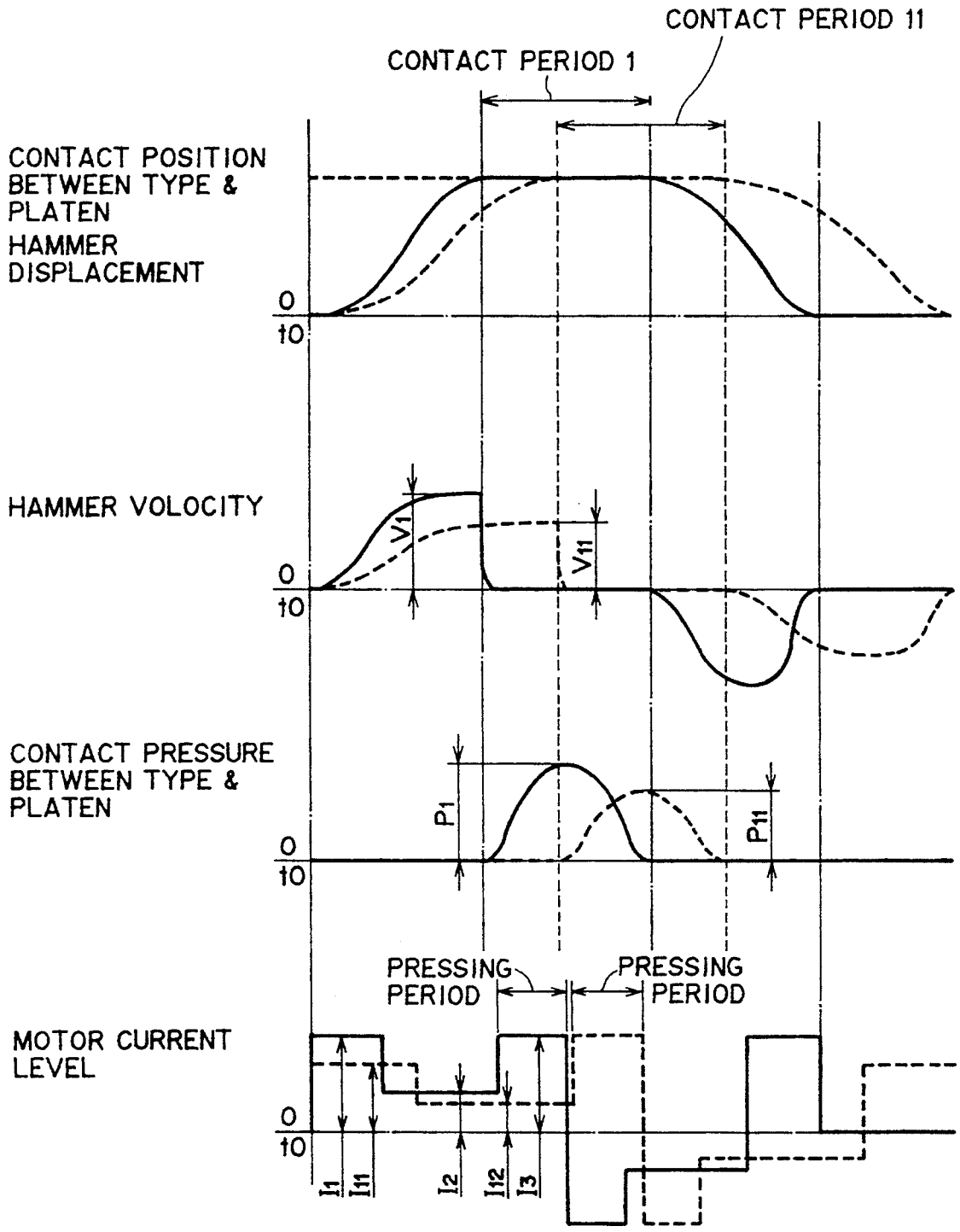
FIG. 14 is a chart showing motor drive current and print hammer movement during a character erasing operation.
Figure 15:
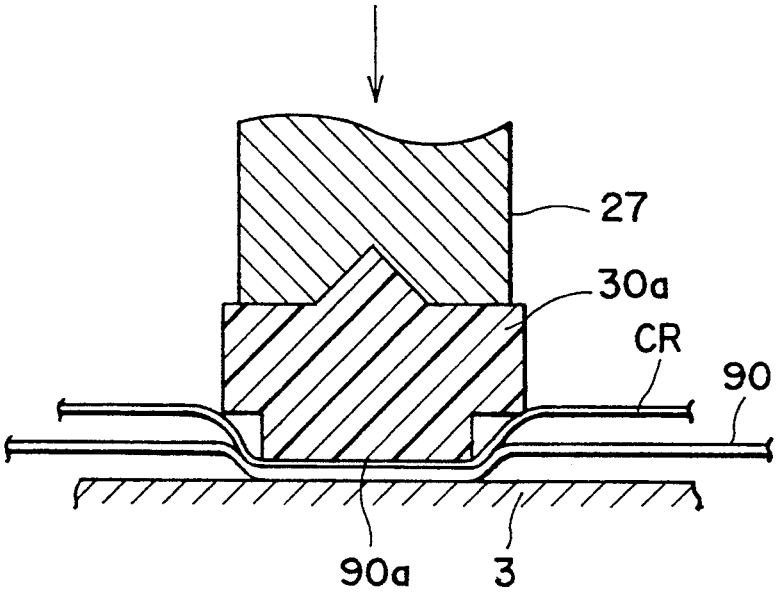
FIG. 15 is a view corresponding to FIG. 12 showing an erasing situation.

As indicted by the broken line in FIG. 14, from the second erasure operation on, the motor 16 is first energized at electric current levels I11 and I12, which are lower than the electric current levels I1 and 12 used during the first erasure operation. The print hammer 27 therefore strikes the print paper 90 through the type 30*a* and the correction ribbon CR at a hammer velocity which is lower than the hammer velocity V1 of the first erasure operation. Afterward, the motor 16 is energized at the same motor electric current level of I3 as during the first erasure operation so the print hammer 27 presses against the print paper 90 through the type 30*a* and the correction ribbon CR. At this moment, the pressing force of the print hammer 27 against the paper (the contact force between the type and the platen) is represented by the broken line P11 shown in FIG. 14, which is less than the pressing force P1 during the first strike.

In this way, the second and subsequent several erasure operation with pressing force less than the first allow the correction ribbon CR to peel off the ink adhering to the periphery of the indentation 90*a*. The ink removed by the correction ribbon CR during the first erasing operation or adhesive will not adhere to the print paper 90.

In the erasure operation of the typewriter according to the depicted embodiment, the motor electric current level applied to the motor at the first erasure operation is identical to the motor electric currents I1 and I2 applied to the motor during the print operation. Therefore, when the print hammer 27 strikes the print paper 90 through the type 30*a* and the correction ribbon CR, the hammer velocity is the same as the hammer velocity V1 during the print operation. Additionally, when the print hammer 27 presses the print paper 90 through the type 30*a* and the correction ribbon CR, the contact pressure is also the same as the contact pressure P1 during a printing operation. However, a motor electric current level in the erase operation can be different from that at the time of printing for obtaining the best erasing quality at the first erasure operation.

The present invention is not limited to the above depicted embodiment. Various modifications are possible without departing from the scope and spirit of the invention. Another embodiment will be described below while referring to FIGS. 17 through 19.

Figure 17:
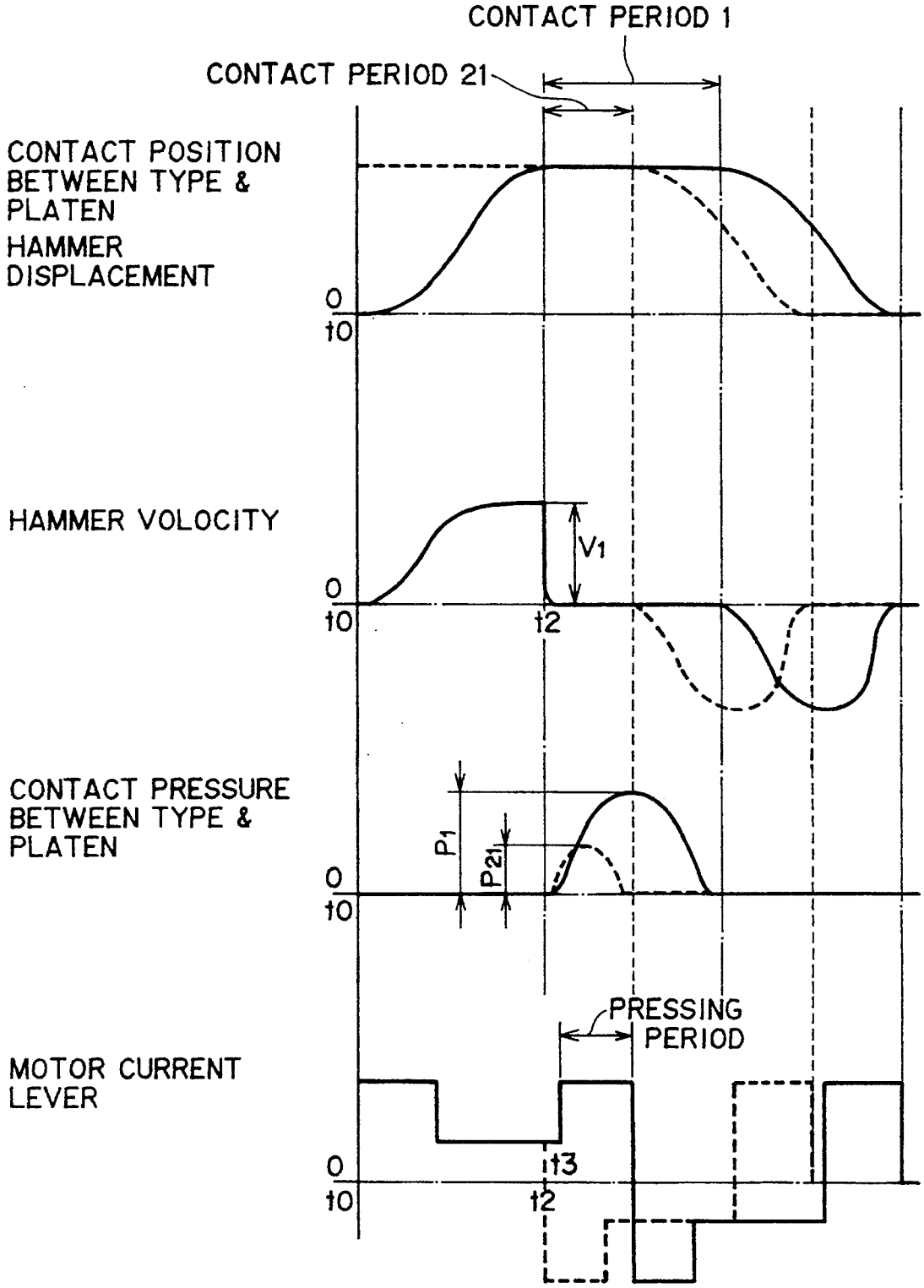
FIG. 17 is a chart corresponding to FIG. 14 showing another embodiment.

As shown in FIG. 17, the pressing force of the second and subsequent erasure operation, which are weaker than the first, is achieved by reversing the current from the instant the print hammer 27 abuts the print paper 90 through the type 30*a* and the correction ribbon CR in order to reverse the direction of the motor 16.

In the same way as in the above depicted embodiment, the same motor electric current level is used from the start time t0 to energize the motor 16 in the first erasure operation and in the second and subsequent erasure operations after the first erasure operation. In the second erasure, the print hammer 27 strikes the print paper 90 through the type 30*a* and the correction ribbon CR at the hammer velocity V1. From the instant the print hammer 27 strikes the print paper 90 through the type 30*a* and the correction ribbon CR, the control device C applies an electric current (indicated by a broken line in FIG. 17) for reversing the rotation of the motor 16 in order to reverse the rotation of the motor 16.

From this control, the contact time 21 and the contact pressure P21, as indicated by the broken line in FIG. 17, when the print hammer 27 presses the print paper 90 through the type 30*a* and the correction ribbon CR can be made less than the contact time 1 and contact pressure P1 during the first erasure operation. The pressing force of second and subsequent erasure operation can be made less than the pressing force of the first.

Consequently, in this modification, the ink adhering to the periphery of the indentation 90*a* can be peeled off by the correction ribbon CR in the same way as in the above depicted embodiment. Also, the ink peeled of by the correction ribbon CR in the first erasure operation and the adhesive of the correction ribbon CR will not adhere to the print paper 90.

Further, a pressing force that is weaker during the second and subsequent erasure operation than during the first erasure operation can be obtained by energizing the motor 16 with a lower motor electric current level the instant the print hammer 27 abuts the print paper 90 through the type 30*a* and the correction ribbon CR during the second and subsequent erasure operation than is applied at the same instant during the first erasure operation.

Figure 18:
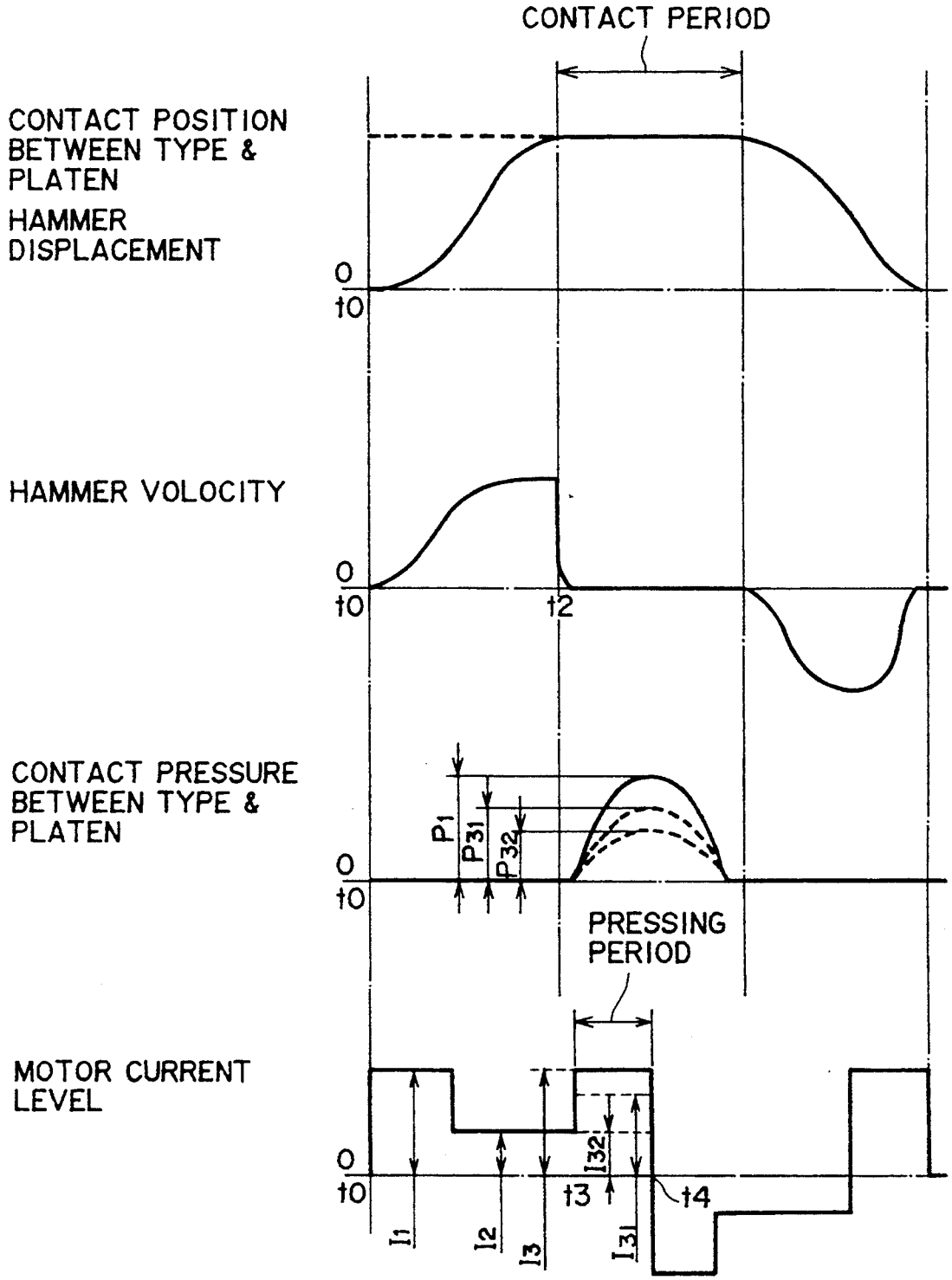
FIG. 18 is a chart corresponding to FIG. 14 showing still another embodiment.

That is, as shown in FIG. 18, the first erasure operation is made in the same way as in the above depicted embodiment, and in the second and subsequent erasure operations, the motor 16 is energized with the motor electric current level the same as that of the first erasure from time t0 when erasing operation starts until the print hammer 27 strikes the print paper 90 through the type 30*a* and the correction ribbon CR. From the instant the print hammer 27 strikes the print paper 90 through the type 30*a* and the correction ribbon CR during the second and subsequent strikes, the control device C energizes the motor 16 at a motor electric current level I31 or I32 (indicated by a broken line in FIG. 18) that is less than the motor electric current level I3 applied to the motor 16 at the same instant during the first erasure operation.

By way of this control, as indicated by the broken line in FIG. 18, the contact pressure P31 or the contact pressure P32 when the print hammer 27 presses the print paper 90 through the type 30*a* and the correction ribbon CR during the second and subsequent erasure operation can be made smaller than the contact pressure P1 during the first erasure operation.

Therefore, in this modification also the ink adhering to the periphery of the indentation 90*a* can be peeled off by the correction ribbon CR in the same way as in the above depicted embodiment. Also, the ink peeled off by the correction ribbon CR in the first erasure operation and the adhesive of the correction ribbon CR will not adhere to the print paper 90.

Still further, a pressing force that is weaker during the second and subsequent erasure operation than during the first erasure operation can be obtained by energizing the motor 16 for a shorter time the instant the print hammer 27 abuts the print paper 90 through the type 30*a* and the correction ribbon CR during the second and subsequent erasure operation than the time the motor is energized at the same instant during the first erasure operation.

Figure 19:
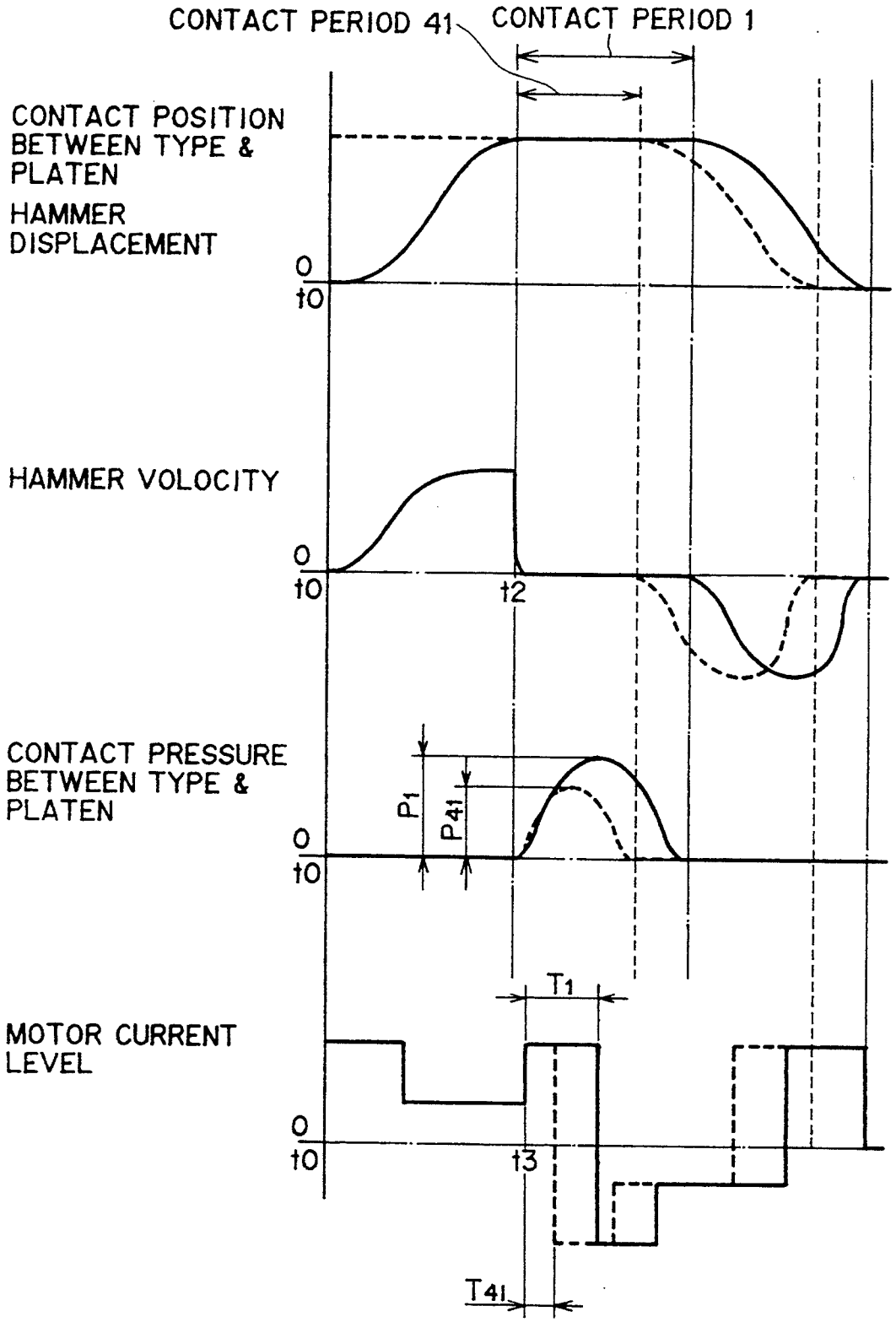
FIG. 19 is a chart corresponding to FIG. 14 showing still another embodiment.

That is, as shown in FIG. 19, after the first erasure operation is made in the same way as in the above depicted embodiment, and in the second and subsequent erasure operations, the motor 16 is energized with the motor electric current level the same as that in the first erasure from time t0 when erasing operation starts until the print hammer 27 strikes the print paper 90 through the type 30*a* and the correction ribbon CR. Although from the instant the print hammer 27 strikes the print paper 90 through the type 30*a* and the correction ribbon CR, the control device C energizes the motor 16 at a motor electric current level that is the same as the motor electric current level I3 applied to the motor 16 during the first erasure operation, the duration of energizing, time T41, is shorter than the duration of energizing, time T1, of the first erasure operation.

By way of this control, as indicated by the broken line in FIG. 19, the contact time 41 and the contact pressure P41 when the print hammer 27 presses the print paper 90 through the type 30*a* and the correction ribbon CR can be smaller than the contact time 1 and the contact pressure P1 during the first erasure operation. Pressing force during the second and subsequent erasure operation is weaker than the pressing force of the first.

Therefore, in this modification also the ink adhering to the periphery of the indentation 90*a* can be peeled off by the correction ribbon CR in the same way as in the above depicted embodiment. Also, the ink peeled off by the correction ribbon CR in the first erasure operation and the adhesive of the correction ribbon CR will not adhere to the print paper 90.

Still further, by combining the above depicted modifications, the pressing force used during the second and subsequent erasure operation can be made weaker than the pressing force used in the first. Also, other methods of controlling the speed of the motor 16 are possible, such as, controlling the voltage applied to the motor 16, applying an external load (such as a brake), and the like.

As is clear from the above description, when erasing a character printed by several pressing operations in a printer according to the present invention, wherein printing operation is performed by a print hammer, which is operatively driven by the rotation of a cam rotatably driven by the motor, pressing without impact against the print paper 90 through the type 30*a* and the correction ribbon CR, all the printed character can be erased because the pressing force of the print hammer during the second and subsequent pressings is weaker than during the first. Also, the noise generated at that time can be reduced.

While the invention has been described in detail and with reference to specific embodiments thereof, it would be apparent to those skilled in the art that various changes and modifications may be made therein without departing from the spirit and scope of the invention.

What is claimed is:

1. A printer for generating a printed character on a printing paper using a print ribbon and for erasing the printed character using a correction ribbon, the printer comprising:

a platen;

a carriage driven to reciprocally follow the platen, the carriage mounting thereon a daisy wheel having a plurality of types, a print ribbon, a correction ribbon, a print hammer, a cam unit, and a drive motor for rotatably driving the cam unit, printing operation being made by non-impactedly pressing one of said plurality of types against the printing paper and the platen through the print ribbon by means of the print hammer operatively driven by the rotation of the cam unit, and the erasure operation being performed by pressing a plurality of times said one of the plurality of types onto the printing paper and the platen through the correction ribbon by means of the print hammer;

a motor control means for controlling rotation of the motor during erasure operation including means for providing a first pressing force applied by the print hammer and, during second and subsequent pressings, means for providing a pressing force by the print hammer smaller than the first pressing force.

2. The printer as claimed in claim 1, wherein the motor control means controls the rotation of the drive motor so that the velocity of the print hammer is slower at an instant the type reaches the print paper during the second and subsequent erasure operation than at a similar instant during the first erasure operation.

3. The printer as claimed in claim 1, wherein the motor control means invertingly drives the motor only at the instant the tape reaches the print paper during a second and subsequent pressing operations of the hammer during erasure operation.

4. The printer as claimed in claim 1, wherein the motor control means applies a smaller current level to the motor directly after the type reaches the print paper during the second and subsequent erasure operation than directly after the type reaches the print paper during the first erasure operation.

5. The printer as claimed in claim 1, wherein the motor control means controls the motor so that the type is pressed against the print paper for a shorter time directly after the type reaches the paper during the second and subsequent erasure operation than directly after the type is pressed against the print paper during the first erasure operation.

6. The printer as claimed in claim 1, wherein the carriage comprises:

at least one main frame movable along the platen, the daisy wheel, the cam unit, the drive motor and the print hammer being supported on the main frame; and a holder member pivotally supported at a position above the main frame, the holder member having a printing position and an erase position, the print ribbon and the correction ribbon being mounted on the holder member.

7. The printer as claimed in claim 6, wherein the cam unit comprises;

a print cam coupled to the drive motor and operatively connected to the print hammer for moving the print hammer toward and away from the platen in response to the rotation of the print cam; and a lifter cam operatively connected to the holder member for pivotally moving the holder member between the printing position and the erase position.

8. The printer as claimed in claim 7, wherein the cam unit further comprising a ribbon supply cam for winding the print ribbon, the ribbon supply cam and the lifter cam forming an integral unit.

9. The printer as claimed in claim 8, wherein the print cam has a whirl shape containing a greatly increasing radius portion and a moderately increasing radius portion contiguous therewith, the greatly increasing radius portion providing high speed of the print hammer at a spaced distant zone thereof relative to the platen, and the moderately increasing radius portion providing reduced speed of the print hammer at a closed distant zone thereof relative to the platen.

10. The printer as claimed in claim 9, wherein the motor control means controls the rotation of the drive motor so that the velocity of the print hammer is slower at an instant the type reaches the print paper during the second and subsequent erasure operation than at a similar instant during the first erasure operation.

11. The printer as claimed in claim 9, wherein the motor control means invertingly drives the motor only at the instant the tape reaches the print paper during a second and subsequent pressing operations of the hammer during erasure operation.

12. The printer as claimed in claim 9, wherein the motor control means applies a smaller current level to the motor directly after the type reaches the print paper during the second and subsequent erasure operation than directly after the type reaches the print paper during the first erasure operation.

13. The printer as claimed in claim 9, wherein the motor control means controls the motor so that the type is pressed against the print paper for a shorter time directly after the type reaches the paper during the second and subsequent erasure operation than directly after the type is pressed against the print paper during the first erasure operation.

* * * * *